US006759799B2

(12) United States Patent
Ricaud

(10) Patent No.: US 6,759,799 B2
(45) Date of Patent: Jul. 6, 2004

(54) OXIDE-COATED CATHODE AND METHOD FOR MAKING SAME

(75) Inventor: Jean-Luc Ricaud, Dijon (FR)

(73) Assignee: Thomson Licensing S. A., Boulogne Cedex (FR)

( * ) Notice: Subject to any disclaimer, the term of this patent is extended or adjusted under 35 U.S.C. 154(b) by 0 days.

(21) Appl. No.: 10/049,453

(22) PCT Filed: Jun. 7, 2001

(86) PCT No.: PCT/FR01/01762

§ 371 (c)(1),
(2), (4) Date: Jul. 30, 2002

(87) PCT Pub. No.: WO01/97247

PCT Pub. Date: Dec. 20, 2001

(65) Prior Publication Data

US 2004/0000854 A1 Jan. 1, 2004

(30) Foreign Application Priority Data

Jun. 14, 2000 (FR) ..... 00 07540

(51) Int. Cl.[7] ..... H01J 1/14; H01J 1/144
(52) U.S. Cl. ..... 313/346 R; 313/337; 445/50
(58) Field of Search ..... 313/346 R, 346 DC, 313/337, 270; 445/51, 50

(56) References Cited

U.S. PATENT DOCUMENTS

| | | | | |
|---|---|---|---|---|
| 3,257,703 A | | 6/1966 | Coad et al. | 29/25.17 |
| 4,273,683 A | | 6/1981 | Kawamura | |
| 4,310,777 A | | 1/1982 | Fukushima et al. | |
| 4,313,854 A | | 2/1982 | Sunahara et al. | 252/516 |
| 4,369,392 A | * | 1/1983 | Hotta et al. | 313/346 R |
| 4,382,206 A | * | 5/1983 | Kumada et al. | 313/346 R |
| 4,446,404 A | * | 5/1984 | Kumada et al. | 313/346 R |
| 4,797,593 A | | 1/1989 | Saito et al. | |
| 4,924,137 A | | 5/1990 | Watanabe et al. | |
| 5,519,280 A | | 5/1996 | Shon et al. | |
| 5,592,043 A | | 1/1997 | Gärtner et al. | |
| 5,925,976 A | | 7/1999 | Hayashida et al. | |
| 5,977,699 A | | 11/1999 | Joo et al. | |
| 6,054,800 A | * | 4/2000 | Joo et al. | 313/270 |
| 6,390,877 B2 | * | 5/2002 | Kim et al. | 445/51 |

FOREIGN PATENT DOCUMENTS

FR 1107589 1/1956

OTHER PUBLICATIONS

T. Ohira et al. "An Analysis of the Surface of the NI–W Layer of Tungsten Film Coating Cathode", Applied Surface Science, Elsevier Amsterdam, vol. 146, pp. 47–50.

* cited by examiner

*Primary Examiner*—Nimeshkumar D. Patel
*Assistant Examiner*—Karabi Guharay
(74) *Attorney, Agent, or Firm*—Joseph S. Tripoli; Carlos M. Herrera; Richard LaPeruta, Jr.

(57) ABSTRACT

The oxide cathode comprises a support and an oxide layer on the latter. It furthermore includes particles of a conducting material having a first end incorporated in the support and a second end lodged in the oxide layer, so as to constitute conducting bridges passing through an interface layer forming between the support and the oxide layer. The invention also relates to a process for manufacturing such a cathode. The conducting particles make it possible to improve the electrical conductivity of the cathode, both within the oxide layer and within the interface layer.

19 Claims, 5 Drawing Sheets

OXIDE-COATED CATHODE AND METHOD FOR MAKING SAME

CROSS-REFERENCE TO RELATED APPLICATIONS

This application claims the benefit, under 35 U.S.C. §365 of International Application PCT/FR01/01762, filed Jun. 7, 2001, which was published in accordance with PCT Article 21(2) on Dec. 20, 2001 in French and which claims the benefit of French patent application No. 00/07540 filed Jun. 14, 2000.

FIELD OF THE INVENTION

The present invention relates to the field of electron tubes, and especially cathodes whose function in these tubes is to emit electrons and thus constitute the source of an electron current.

More particularly, the invention relates to so-called oxide cathodes. These cathodes, which are the most widely used, comprise a layer of oxides which are strong electron emitters on one face of a metal support. The support is connected to an electric potential which is negative relative to the surrounding potential, allowing an electron flux to be emitted from the oxide layer.

BACKGROUND OF THE INVENTION

FIG. 1 is a simplified sectional view showing a cross section through a conventional oxide cathode 2. The support 1 consists of a thin nickel plate forming a pill which has a face 1*a* covered with an oxide layer 3 in the form of a washcoat. The washcoat is a coating consisting of an active compound filler and of a binder. The active compound is generally based on barium carbonate ($BaCO_3$) and on carbonates of other elements, which are subsequently converted to barium oxide (BaO) and oxides of other elements.

The oxide layer normally has to be at a relatively high temperature to emit. In the conventional case of a so-called indirectly-heated cathode, a heat source, such as a filament, is provided near the support and connected to a low-voltage current source.

In operation, an electron current flows though the thickness of the oxide layer 3 (arrow I) due to the effect of the surrounding electric field. The electric field is created by establishing a potential difference between the support 1 and an electrode 5 located near the external surface 3*a* of the layer 3. In the example, the support is referenced at an earth voltage while the electrode 5 is biased at a high positive voltage +V. The electron flux obtained by the cathode 2 is proportional to the intensity of this electron current I.

FIG. 2 shows the same cross section through the cathode 2 after it has changed over time. It may be seen that a resistive layer 6, called an interface layer, has grown between the metal support 1 and the washcoat layer 3.

In some applications, it is necessary to try to obtain as high an electron current in the cathode as possible. This is especially the case with cathode-ray tubes for "multimedia" and "high-resolution" display screens, as well as for video projectors and other types of electron tubes, such as those used in the microwave field.

It is known that the intensity of the electron current that can be obtained from an oxide cathode is limited because it does not have a high enough conductivity. This is essentially the conductivity through the thickness of the washcoat layer 3 and the interface layer 6—that through the support 1 may be regarded as negligible. It should be noted that the conductivity of a layer is inversely proportional to its resistivity.

Moreover, it appears that oxide cathodes do not withstand a high current density well, particularly when the current is constant over time, on account of their insufficient electrical conductivity.

It is generally accepted that the insufficient electrical conductivity of oxide cathodes is due to two parameters: the fact that the emissive washcoat 3 is based on oxides which by nature are poor conductors and the fact that the resistive interface layer 6, between the metal of the support 1 and the washcoat, grows.

FIG. 3 is an equivalent electrical circuit of the components R1 and R2 of the electrical resistivity of the oxide cathode, deriving from the emissive washcoat layer 3 and from the interface layer 6, respectively. As these two layers are superposed, the components R1 and R2 combine as resistors in series.

The contribution of the washcoat layer 3 to the electrical resistivity changes over the lifetime of the cathode. This is because metallic barium is created in this layer by the reaction between the barium oxides BaO and the reducing elements which diffuse out of the nickel. This metallic barium, the primary role of which is to move to the surface of the washcoat in order to allow electron emission, gives the washcoat electrical conductivity. However, the amount of metallic barium decreases for two reasons:

- the generation of metallic barium is gradually exhausted because of the fact that the reducing elements must come, by diffusion, from an increasing depth in the nickel; and
- the interface layer 6 itself acts as a diffusion barrier with respect to these reducing elements.

The contribution of the interface layer 6 to the electrical conductivity changes during the lifetime because this interface grows. The growth of this interface is due to chemical reactions between the washcoat and the reducing elements contained in the nickel (such as Mg, Si, Al, Zr, W, etc.) which accumulate compounds in this interface. These compounds are rather poor conductors since they are, above all, oxides such as MgO, $Al_2O_3$, $SiO_2$, $Ba_2SiO_4$, $BaZrO_3$, $Ba_3WO_6$, etc.

The origin of the electrical resistivity of oxide cathodes and its changeover time have been studied in the prior art for the purpose of increasing the electron current density that can be sustained.

Certain known solutions aim to reduce the resistivity of the oxide layer 3 by generally incorporating a conductive filler into it. For example:

- U.S. Pat. No. 4,369,392 proposes to incorporate nickel powder into the washcoat, which in this case is carried out by pressing and then sintering;
- U.S. Pat. No. 4,797,593 provides a solution which comprises adding scandium oxide or yttrium oxide to the washcoat, one of the effects of which is to improve the electrical conductivity;
- U.S. Pat. No. 5,592,043 proposes a washcoat in the form of a solid object containing metals (W, Ni, Mg, Re, Mo, Pt) and oxides (of Ba, Ca, Al, Sc, Sr, Th, La) which increase the electrical conductivity by a "percolation" effect; and
- U.S. Pat. No. 5,925,976 proposes the addition of metals (Ti, Hf, Ni, Zr, V, Nb, Ta) to the washcoat.

Other known solutions aim to attenuate the effect of the interface layer 6. For example:

- U.S. Pat. No. 4,273,683 pertains to the case of an interface formed above all from $Ba_3WO_6$. A layer of nickel powder is deposited on the nickel support prior to washcoating and, in addition, a barium carbonate concentration gradient is produced in the thickness of the washcoat. The $BaCO_3$ concentration is less in the region touching the interface, so that less $Ba_3WO_6$ compound is created;

U.S. Pat. No. 5,519,280 describes a solution in which indium tin oxide (a complex based on $In_2O_3$ and $SnO_2$) is incorporated into the washcoat and acts by providing conductivity and by limiting the growth of the interface;

U.S. Pat. No. 5,977,699 proposes the addition of a zirconium (Zr)-based layer between the nickel of the support and the washcoat, this layer decreasing the interface in terms of its reducing-agent property; and in the minutes of the conferences "International Vacuum Electron Sources Conferences" IVESC98, which were held at Tsukuba (Japan) on Jul. 7–10, 1998, the publication entitled "An analysis of the surface of the NiW layer of tungsten film coating cathode" by Takuya Ohira et al. describes a solution in which a layer of tungsten powder is deposited on the nickel of the support prior to the washcoating and explains that this layer has an effect of dispersing the reducing elements (Si and Mg) so that the compounds (especially $Ba_2SiO_4$) resulting from the chemical reactions at the interface are less concentrated and that, consequently, the interface is less of a barrier.

It has also been proposed in U.S. Pat. No. 4,924,137 to ensure that the barium produced by reaction between the oxide layer and the support is absorbed in the washcoat rather than disappearing by evaporation. For this purpose, scandium oxide and an oxide of Al, Si, Ta, V, Cr, Fe, Zr, Nb, Hf, Mo, or W are incorporated into the washcoat.

Finally, solutions have also been proposed in the context of so-called directly heated cathodes. By way of example, U.S. Pat. No. 4,310,777 recommends, in the case of a nickel support having a large amount of tungsten, a small concentration of zirconium in the nickel within a relatively narrow range. Similarly, U.S. Pat. No. 4,313,854 proposes, in the case of a nickel support with a high percentage of refractory metal, interposing a layer of metal (Si, B, Ti, Zr, Hf, V, Nb, Ta, Mo, or w) carbides between the nickel and the washcoat so as to limit in this way the growth of the interface.

It should be noted that the solutions of the prior art do not consider, in a unitary way, the properties associated on the one hand with the oxide layer and on the other hand with the interface layer.

Moreover, other types of cathodes exist, called impregnated cathodes, which allow a sustained regime with a high electron current, even if this current is constant over time. These cathodes comprise a porous metal pill impregnated with an emissive material. However, they are complex and their manufacturing costs exclude them from many applications, especially in cathode-ray tubes intended for the commercial market.

SUMMARY OF THE INVENTION

In the light of the foregoing, the subject of the present invention is an oxide cathode comprising a support and an oxide layer on the support. It furthermore includes particles of a conducting material having a first end incorporated in the support and a second end lodged in the oxide layer, so as to constitute conducting bridges passing through an interface layer forming between the support and the oxide layer.

Advantageously, the conducting material of the particles is a carbide of one or more metals, for example:

metals of Group IVB, and preferably at least one metal from: titanium (Ti), zirconium (Zr) and hafnium (Hf);

metals of Group VB, and preferably at least one metal from: vanadium (V), niobium (Nb) and tantalum (Ta);

metals of Group VIB, and preferably at least one metal from: chromium (Cr), molybdenum (Mo) and tungsten (W).

The support may be made of metal, preferably a nickel-based metal.

The invention also relates to an electron tube, for example a cathode-ray tube, comprising an oxide cathode of the aforementioned type. The cathode-ray tube may be intended for so-called "multimedia" television applications.

The invention also relates to a process for manufacturing an oxide cathode in which an oxide layer is deposited on a support, this process comprising the steps consisting in:

furnishing that surface of the support which is intended to receive the oxide layer with particles of conducting material so that the particles have a first end incorporated in the support and a second end which is exposed; and covering the surface with an oxide layer.

According to a first method of manufacture, the step of furnishing the particles of conducting material consists in spreading the particles out over said surface and in applying a force to the particles in order to encrust the first end of the particles in the support.

According to a second method of manufacture, the step of furnishing the particles of conducting material consists in incorporating the particles in the support and in making the second end of the particles stand out by a surface treatment, for example by means of selective chemical etching treatment.

The particles may be incorporated into the support during the metallurgical production of the latter.

When the support is formed by drawing, the second end of the particles is exposed either before or after the drawing.

BRIEF DESCRIPTION OF THE DRAWINGS

The invention and the advantages which accrue therefrom will be more clearly apparent on reading the description which follows preferred embodiments, given purely by way of non-limiting example, with reference to the appended drawings in which.

DETAILED DESCRIPTION OF THE PREFERRED EMBODIMENTS

Figure 2:
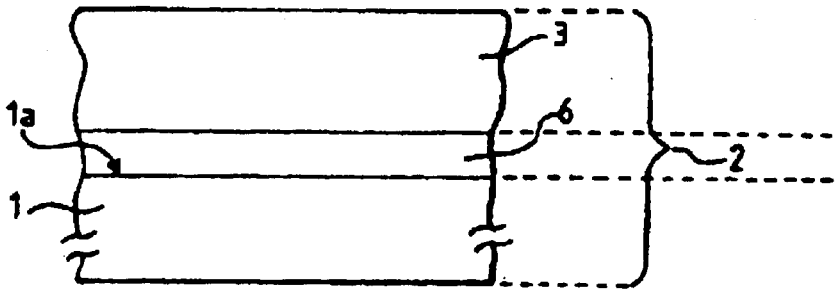
FIG.2 (Prior Art)
FIG. 2, already described, is a partial and simplified sectional view of a conventional oxide cathode in which an interface layer has formed.
Figure 4:
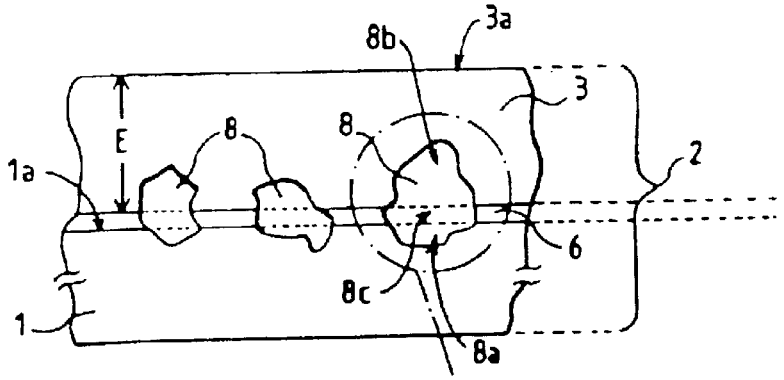
FIG. 4 is a partial and simplified sectional view of an oxide cathode according to the present invention.

The base structure of a cathode 2 in accordance with the invention is illustrated schematically by the sectional view in FIG. 4. This illustration is similar to that in FIG. 2 and the common parts of these two figures bear the same reference numbers.

Thus, the figure shows a nickel-based conducting support 1 on a surface 1*a* of which an oxide layer 3 in the form of a washcoat is deposited. In use, an interface layer 6 forms between the aforementioned surface 1*a* and the oxide layer 3, as described previously with reference to FIG. 2.

In the examples which follow the case of an indirectly heated oxide layer will be considered, that is to say a cathode which is heated to temperature by a heat source external to the support 1, for example by means of a filament near the support and connected to a low-voltage current source. However, the invention may also apply in the case of a directly heated cathode.

In accordance with the invention, the cathode 2 includes particles 8 of conducting material which are located at the boundary between the support 1 and the oxide layer 3. The particles 8 are distributed approximately uniformly over the entire surface (or at least part of it) occupied by the oxide layer 3.

Figure 4A:
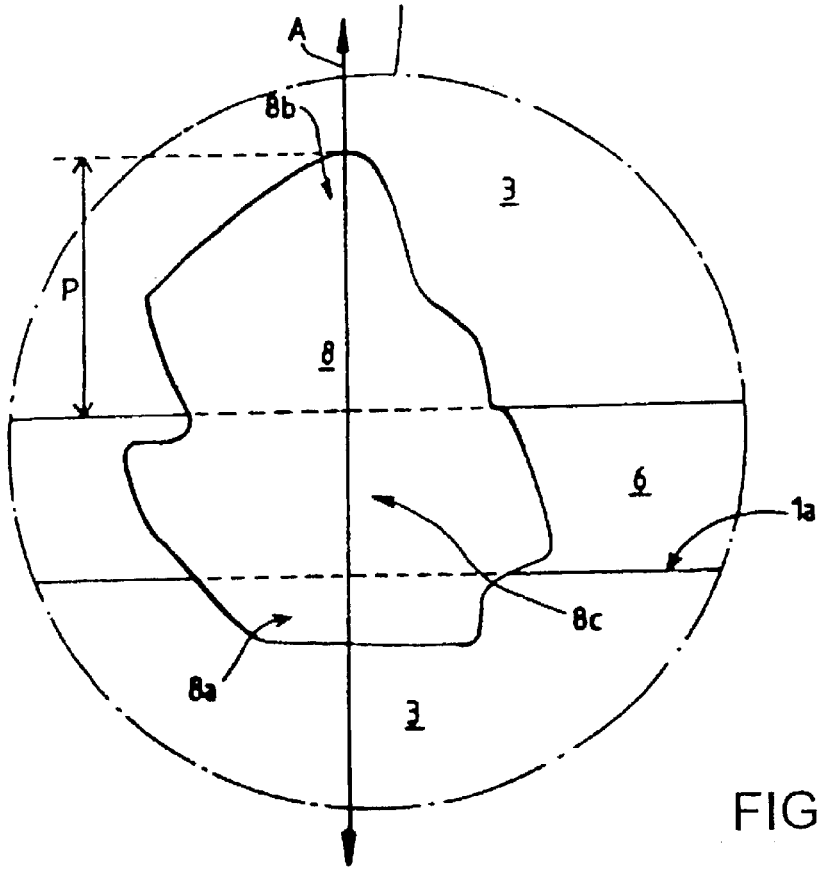
FIG. 4*a* is a magnification showing in detail the imbrication of a particle of conducting material in the cathode of FIG. 4.

As shown in greater detail in FIG. 4*a*, each particle 8 has a first end 8*a* which penetrates the aforementioned surface 1*a* of the support 1 so as to be encrusted in the support and a second end 8*b* which is lodged in the thickness of the oxide layer 3. These two ends 8*a* and 8*b* are, within the limit of the irregularity in the shape of the particle, mutually opposed on an axis A perpendicular to the surface 1*a* of the support.

An intermediate part 8*c* of the particle passes right through the thickness of the interface layer 6. The particle 8 therefore constitutes a conducting bridge which establishes an electrically conducting link connecting the body of the support 1 to the terminal point of the second end 8*b*, that is to say within the oxide layer 3.

It should be noted that the mean particle size compared with the thickness of the oxide layer 3 may be tailored so that the projection P along the aforementioned axis A of that part of a particle 8 which is lodged in the oxide layer 3 occupies a greater or lesser proportion of the thickness E of this layer according to the desired properties.

Figure 5:
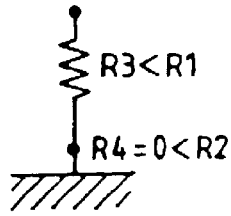
FIG. 5 is a theoretical electrical circuit showing the components contributing to the electrical resistivity of the cathode of FIG. 4.

The effect of the presence of the particles 8 on the lowering of the electrical resistivity due to the oxide layer 3 and to the interface layer 6 will now be analyzed with reference to FIG. 5.

Figure 1:
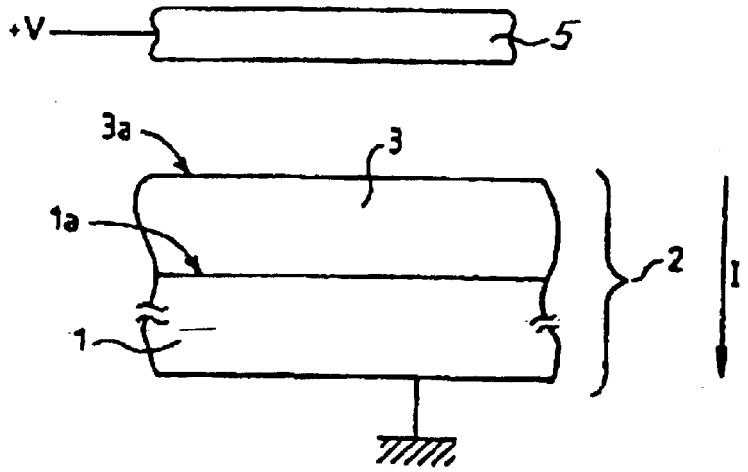
FIG.1 (Prior Art)
FIG. 1, already described, is a partial sectional and simplified view of a conventional oxide cathode and of an electrode used for creating an electric field conducive to electron emission.
Figure 3:
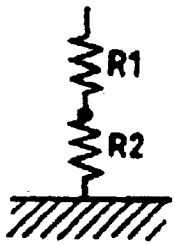
FIG.3 (Prior Art)
FIG. 3 is a theoretical electrical circuit showing the contribution of the oxide layer and of the interface layer to the electrical resistivity of the cathode of FIG. 2.

In this figure, it is assumed that the cathode 2 is referenced at an earth potential, as in the case of FIGS. 1 and 3, and the electrical resistivity of the support, this being a good conductor, is neglected. We consider the electrical resistivity in the direction of axis A perpendicular to the general plane of the cathode 2 over a section starting from the aforementioned surface 1*a* of the support and ending on the exposed surface 3*a* of the oxide layer. This section is divided into two parts: a first part containing the thickness of the oxide layer 3 and a second part containing the thickness of the interface layer 6. Since these parts are superposed, their resistivities combine additively. The resistivity of the first part is denoted R3 (to be compared with R1 of FIG. 3) and the resistivity of the second part is denoted R4 (to be compared with R2 of FIG. 3).

The resistivity R4 of that part of the cathode 2 which contains the interface layer 6 appears to be negligible. This is because, the particles 8 being good conductors, this layer is effectively short-circuited by the conducting bridge effect that each particle 8 provides. Moreover, all the particles 8 together constitute a set of parallel connections distributed over the entire active surface of the oxide layer.

With regard to the electrical resistivity R3 of that part of the cathode 2 which contains the oxide layer 3, this is also lower than the resistivity R1 of a conventional cathode without the particulate material. This is because the penetration of the particles 8 within a certain proportion of the layer 3 also creates a conducting bridge effect within the latter. The electrical resistivity is improved in this proportion.

Thus, by providing the presence of imbricated conducting particles 8 in accordance with the present invention, a reduction in the resistivity both of the interface layer 6 (this becoming virtually zero) and of the oxide layer 3 is obtained by this unique means.

Preferably, a material is chosen for the grains 8 which satisfies several criteria: to be hard enough to be able to be encrusted in the nickel (or other metal) of the support 1, not to poison the emission from the cathode 2, to be an electrical conductor, to withstand oxidation (especially that caused by the conversion of the carbonates into oxides), to be chemically stable and especially not to react with the elements of the cathode, and not to evaporate excessively nor to diffuse excessively under the operating conditions of the cathode.

Metals having a relatively high melting point oxidize more than nickel does and therefore do not represent the best solution, and metal oxides may prove not to conduct electricity sufficiently. On the other hand, optimum realization may be achieved using metal carbides. Among the latter, it may be advantageous to choose one or more from:

- carbides of Group IVB, and especially of titanium (Ti), zirconium (Zr) and hafnium (Hf);
- carbides of Group VB, and especially of vanadium (V), niobium (Nb) and tantalum (Ta); and
- carbides of Group VIB, and especially of chromium (Cr), molybdenum (Mo) and tungsten (W).

This is because the metal carbides listed above satisfy all the criteria:

a) they are very hard (Vickers hardness >1000 HV);

b) they are chemically stable and even inert, and consequently cannot be cathode emission poisons;

c) they are good electrical conductors (electrical resistivity <100 $\mu$ohms.cm);

d) they have a very high oxidation resistance (for example, tantalum carbide (TaC), niobium carbide (NbC) and zirconium carbide (ZrC) withstand oxidation in air up to approximately 800° C); and e) they evaporate very little since they are thermally very stable because of their high melting point (for example, hafnium carbide (HfC), niobium carbide (NbC), tantalum carbide (TaC), titanium carbide (TiC) and zirconium carbide (ZrC) have melting points greater than 3000° C., which are among the highest of all materials.

Figure 6A:
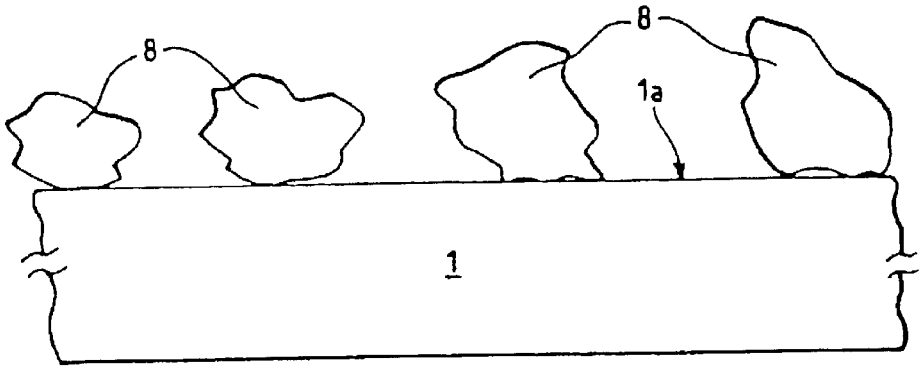
FIGS. 6*a* to 6*c* illustrate various steps in the production of a cathode according to a first method of manufacture in accordance with the present invention.
Figure 6B:
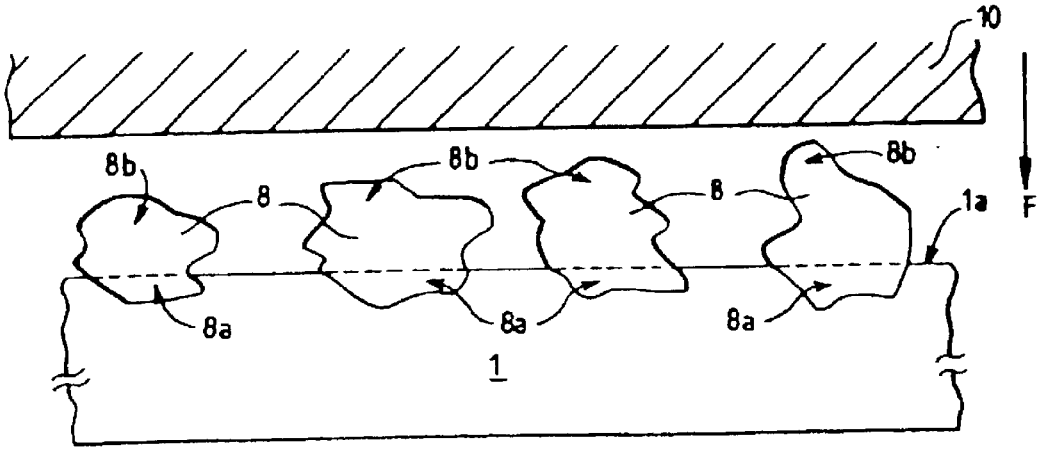
Figure 6C:
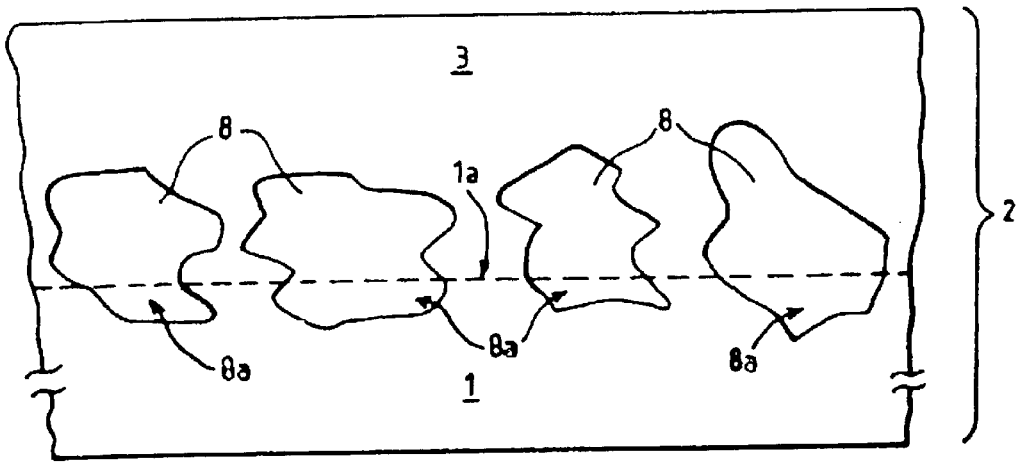

A first method of manufacturing oxide cathodes in accordance with the invention will now be described with reference to FIGS. 6*a* to 6*c*.

The method begins with a cathode preform simply comprising the conducting support 1. In the example, this is a continuous strip of nickel-based material 1 which will be cut and drawn in order to form the support in all its final dimensions. As shown in FIG. 6*a*, a powder composed of particles 8 of one or more metal carbides according to the composition described above is spread out over a surface 1*a* of this strip.

Next, that part 8*a* of the particles 8 which forms the end in contact with the surface 1*a* is encrusted in the material of the support 1 by applying a compressive force to the opposite end 8*b* of the particles in the direction of the arrow F (FIG. 6*b*) Several techniques may be used to apply this encrustation pressure. In the example illustrated, the latter is obtained by means of a vertical press 10 positioned above the particles and controlled in order to obtain the desired degree of encrustation. It is also conceivable to pass the strip 1 with its surface deposit of powder between a pair of compressing rolls in order to obtain the same technical effect. If necessary, the support 1 may be heated in order to allow better penetration of the particles 8.

Once the particles 8 have been encrusted, the oxide layer 3 is deposited so as to cover the exposed portions of the surface 1*a* of the strip and of the particles 8. In the example, the layer completely embeds the exposed parts of the particles. The particles therefore have one end 8*a* incorporated in the nickel and one end 8*b* in the washcoat, and thus form conducting bridges as explained above.

The layer 3 is prepared in the form of a washcoat consisting of one or more carbonates and a binder. Typically, as carbonates, barium, strontium and possibly calcium carbonates are used. The interface layer 6 is not illustrated in the figure as it does not appear and develops only during ageing of the cathode 2, by conversion of that part of the oxide layer near the surface 1*a* of the support. It is possible to determine the thickness of this interface layer in advance and consequently to ensure that the height of the non-encrusted parts of the particles 8 is sufficiently great to pass right through this thickness and thus fulfil its function of conducting bridge.

Another method of manufacturing the cathode 2 in accordance with the present invention will now be described with reference to FIGS. 7*a* to 7*d*, in which method the particles 8 are incorporated in the constituent material of the support 1 during the metallurgical production of the latter. In this case too, the support is a nickel-based support.

Figure 7A:
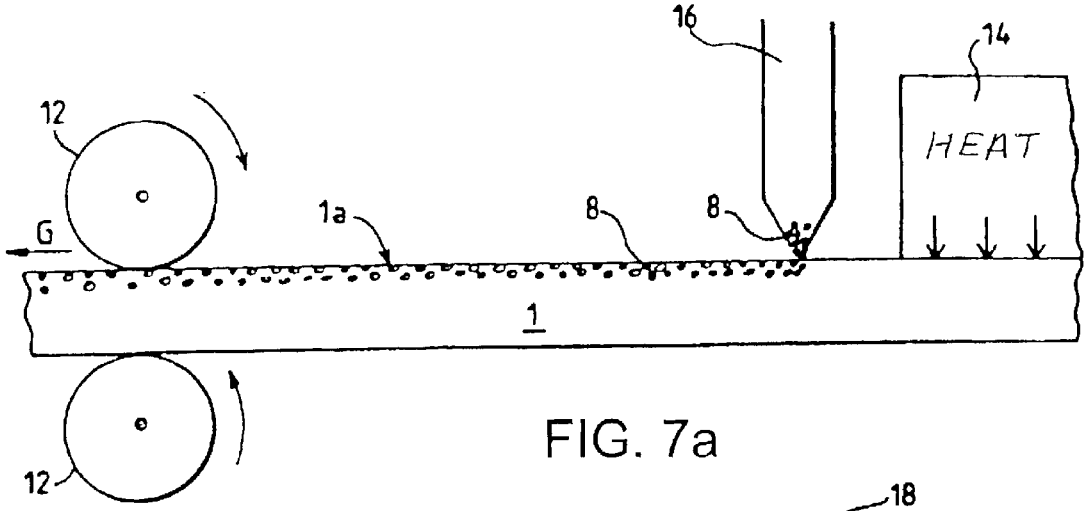
FIGS. 7*a* to 7*d* illustrate various steps in the production of a cathode according to a second method of manufacture in accordance with the present invention.

In the example illustrated in FIG. 7*a*, the support 1 is in the form of a metal tape during the phase of incorporating the particles 8. This tape will then be cut and drawn in order to obtain the support in its final shape.

The tape 1 is moved in the direction of the arrow G by means of rollers 12 so that its surface 1*a* intended to receive the oxide layer runs in succession past a heat source 14 and a gun 16 which sprays the particles 8. The composition of the particles used for this technique may be the same as that for the first method of manufacture.

The function of the heat source 14 is to raise the temperature at the surface 1*a* sufficiently for the metal of the strip to be softened (plastic phase). The heat source may be a device for inducing eddy currents in the metal strip 1.

The gun 16 sprays the particles 8 forcibly against the surface 1*a* of the tape. Since this surface has been softened, the particles penetrate entirely or almost entirely into the body of the strip and are therefore immersed in the latter, near the surface 1*a*, as shown in greater detail in FIG. 7*b*.

Figure 7B:
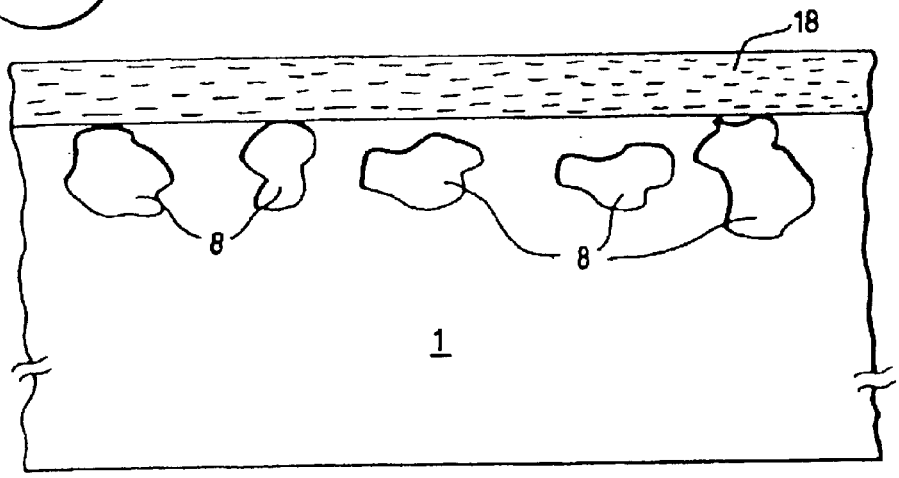

Next, the strip 1 is subjected to a selective chemical etching treatment for the purpose of removing the constituent material of this strip at its surface 1*a* without altering the composition of the particles. In the example, this etching treatment is carried out by depositing an acid 18 in liquid phase on the surface 1*a* of the tape (FIG. 7*b*). Other techniques may be envisaged, such as vapour etching or plasma etching.

Figure 7C:
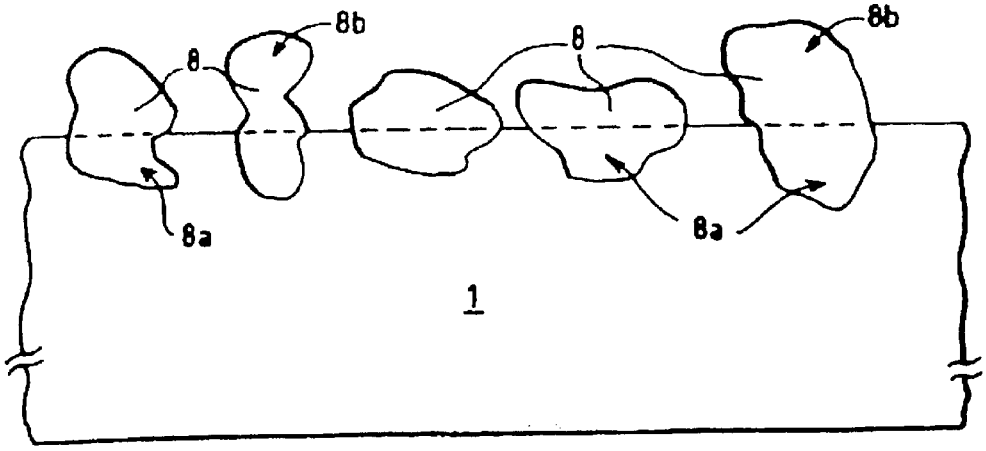

After the chemical etching treatment, the ends 8*b* of the particles 8 facing outwards stand out from the surface, while the opposite ends 8*b* remain imbricated in or integral with the body of the constituent material of the strip 1, as shown in FIG. 7*c*. This result is obtained because of the fact that the metal of the support 1, in this case nickel, is less resistant to the chemical etching or plasma etching treatment than the metal carbides constituting the particles.

Figure 7D:
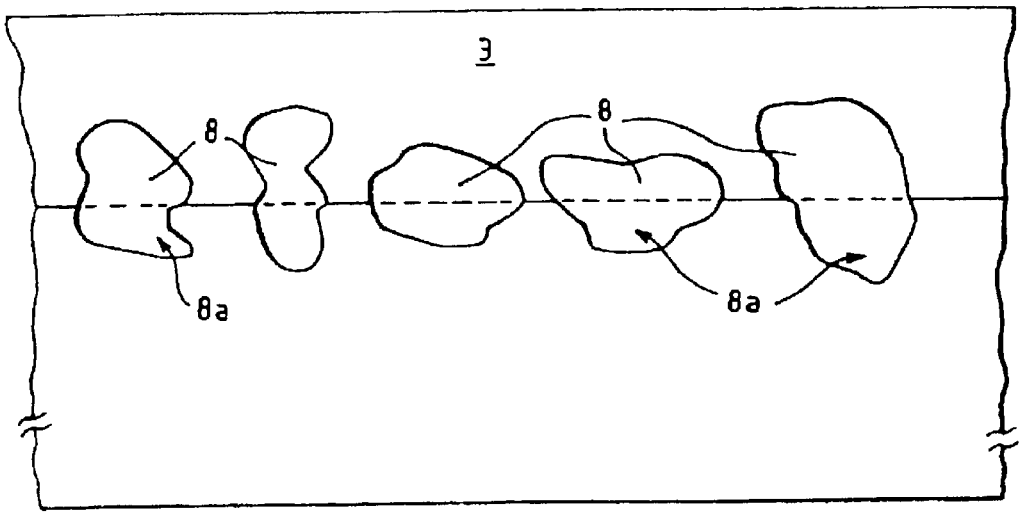

Next, as shown in FIG. 7*d*, a washcoat layer 3 containing carbonates, and especially barium carbonate, forming the emissive part of the cathode, is deposited on the surface 1*a* and the projecting parts of the particles 8.

As in the first method of manufacture (cf. FIG. 6*b*), the exposed parts of the particles 8 after the chemical etching treatment project sufficiently from this surface 1*a* to pass through any interface layer and penetrate the oxide layer of the cathode.

Finally, the strip thus prepared is cut into cathode support preforms and then drawn in order to obtain the body of the cathode.

In a variant of the process according to this second method of manufacture, the aforementioned cutting and possible drawing are carried out before the chemical etching or similar step. In other words, the end 8*b* of the particles 8 is exposed once the support 1 is in the preform state or in its final state.

Finally, another variant of the first method of manufacture consists in incorporating the particles throughout the thickness of the support 1 during one step in the production of this strip. In this case, those of the particles lying close to the surface 1*a* will serve as conducting bridges when their ends 8*a* have been embedded in the washcoat 3 and the other particles will be inactive, without disturbing the operation of the cathode.

It will be understood that the oxide cathode according to the present invention has very wide applications, including all fields in which oxide cathodes are normally used: display tubes (CRTs), microwave tubes, grid tubes, etc.

The invention lends itself to many variants not described, which remain within the competence of those skilled in the art and within the scope of the claims, especially with regard to the choice of materials, the dimensional parameters and the manufacturing processes.

What is claimed is:

1. Oxide cathode comprising a support and an oxide layer on the support, wherein it furthermore includes particles of a conducting material having a first end incorporated in the support and a second end lodged in the oxide layer, so as to constitute conducting bridges passing through an interface layer forming between the support and the oxide layer.

2. Oxide cathode according to claim 1, wherein the conducting material of the particles is a carbide of one or more metals.

3. Oxide cathode according to claim 2, wherein the conducting material of the particles is a carbide of one or more metals of Group IVB, and preferably at least one metal from: titanium, zirconium and hafnium.

4. Oxide cathode according to claim 2 wherein the conducting material of the particles is a carbide of one or more metals of Group VB, and preferably at least one metal from: vanadium, niobium and tantalum.

5. Oxide cathode according to claim 2, wherein the conducting material of the particles is a carbide of one or more metals of Group VIIB, and preferably at least one metal from: chromium, molybdenum and tungsten.

6. Oxide cathode according to claim 1, wherein the support is made of metal, preferably a nickel-based metal.

7. Electron tube, wherein it comprises an oxide cathode according to claim 1.

8. Cathode-ray tube, wherein it comprises an oxide cathode according to claim 1.

9. Process for manufacturing an oxide cathode, in which an oxide layer is deposited on a support, the process comprising the steps of:

furnishing a surface of the support which is intended to receive the oxide layer with particles of conducting material so that the particles have a first end incorporated in the support and a second end which is exposed; and covering said surface with an oxide layer.

10. Process according to claim 9, wherein the step of furnishing the particles of conducting material consists in spreading out the particles over said surface and in applying a force to the particles in order to encrust said first end of the particles in the support.

11. Process according to claim 9, wherein the step of furnishing the particles of conducting material consists in incorporating the particles in the support and in making said second end stand out from the support by a surface treatment, for example by means of a selective chemical etching treatment.

12. Process according to claim 11, wherein the particles are incorporated in the support during the metallurgical production of the support.

13. Process according to claim 11, in which the support is formed by drawing, wherein said second end of the particles is made to stand out before the drawing.

14. Process according to claim 11, in which the support is formed by drawing, wherein said second end of the particles is made to stand out after the drawing.

15. Process according to claim 9, wherein the conducting material of the particles is a carbide of one or more metals.

16. Process according to claim 15, wherein the conducting material of the particles is a carbide of one or more metals of Group IVIB, and preferably at least one metal from: titanium, zirconium and hafnium.

17. Process according to claim 15 wherein the conducting material of the particles is a carbide of one or more metals of Group VB, and preferably at least one metal from: vanadium, niobium and tantalum.

18. Process according to claim 15, wherein the conducting material of the particles is a carbide of one or more metals of Group VIB, and preferably at least one metal from: chromium, molybdenum and tungsten.

19. Process according to claim 9, wherein the support is made of metal, preferably a nickel-based metal.

* * * * *